United States Patent [19]

Stewart

[11] Patent Number: 4,982,930

[45] Date of Patent: Jan. 8, 1991

[54] SIDEWALK LIFTER

[76] Inventor: John V. Stewart, 1308 Henry Balch Dr., Orlando, Fla. 32810

[21] Appl. No.: 245,230

[22] Filed: Sep. 16, 1988

[51] Int. Cl.[5] ..... B66F 3/00

[52] U.S. Cl. ..... 254/124; 254/DIG. 1; 254/131

[58] Field of Search ..... 404/99, 26, 73, 72, 404/71; 414/10, 440, 457, 458, 459, 460, 618, 626; 254/124, 131, DIG. 1, 120, 121, 123, 131.5, 132; 248/188.2, 188.4

[56] References Cited

U.S. PATENT DOCUMENTS

| | | | |
|---|---|---|---|
| 662,342 | 11/1900 | Berry | 254/131 X |
| 684,426 | 10/1901 | Harvey et al. | 254/131 |
| 2,297,556 | 9/1942 | Hermann | 254/DIG. 1 X |
| 2,353,381 | 7/1944 | Allderige | 254/121 |
| 2,846,259 | 8/1958 | Sadler | 254/131 X |
| 3,161,309 | 12/1964 | Baudhuin et al. | 414/459 |
| 3,861,649 | 1/1975 | Mosley | 254/124 |
| 4,261,548 | 4/1981 | Kaderabek | 254/131 |
| 4,368,869 | 1/1983 | Gelvezon et al. | 248/188.2 X |
| 4,482,182 | 11/1984 | Mortensen | 254/131 X |
| 4,681,300 | 7/1987 | Drugge | 254/131 |

FOREIGN PATENT DOCUMENTS

| | | | |
|---|---|---|---|
| 2646646 | 4/1978 | Fed. Rep. of Germany | 254/131 |
| 3131468 | 3/1983 | Fed. Rep. of Germany | 254/131 |
| 248551 | 3/1926 | United Kingdom | 254/131 |
| 1580728 | 12/1980 | United Kingdom | 254/131 |
| 2061218 | 5/1981 | United Kingdom | 254/131 |
| 2203124 | 10/1988 | United Kingdom | 414/457 |

*Primary Examiner*—Robert J. Spar
*Assistant Examiner*—James T. Eller

[57] ABSTRACT

A device for realignment of sidewalk sections displace by settling or tree root lifting, where a hazardous step exists at a joint or crack. A rigid beam is laid longitudinally on the sunken section, with cross beams reaching to the section sides. Hooks are suspended from the ends of the cross beams, and hooked under the edges of the slab. The hooks are shaped for stability, not requiring clamping on, or boring into, the slab. A jack lifts one end of the main beam, raising the hooks, and lifting one end of the slab, with evenly distributed force to avoid cracking the concrete. Fill-dirt is thrown under the raised section to restore vertical alignment. The device is operable by one person. It pivots the slab in a vertical plane, guiding accurate return to position.

13 Claims, 2 Drawing Sheets

SIDEWALK LIFTER

FIELD OF INVENTION

This invention relates to maintenance and repair of concrete sidewalks.

PRIOR ART

Sidewalks lose their alignment over time, due to settling and tree root lifting. This causes steps to form at joints and cracks, which are hazards to sidewalk users, and liabilities to those responsible for maintenance. Current repair options include:

1. Build a ramp of concrete or asphalt from the lower section to the upper one, filling the step. This short ramp is itself a hazard, and has a makeshift, patched appearance. Adhesion of concrete and asphalt to old concrete is poor, so the repair soon degrades.

2. Remove and repour the sunken section. This is expensive and results in a mismatched appearance due to the age difference between sections. If heavy equipment is used to demolish and remove concrete, it can cause damage to landscaping, driveways, curbs, and other structures.

OBJECTS AND ADVANTAGES

The objective of this invention is to provide a means to carefully lift a section of sidewalk, so that dirt can be spread under it to restore alignment. The lifting must be done evenly to avoid cracking the concrete. It should be done without expensive equipment or materials, and without damage to adjacent structures and landscaping. The lifting device should be practical for a single person to handle and operate, allowing low labor cost.

The invention achieves all of these objectives. Multiple lift points supported by a rigid beam distribute force evenly to avoid cracking the section. The device can be inexpensively made, and can be installed and operated by one person. Thus, equipment and labor cost per repair are low. Material costs are literally dirt cheap, since dirt is the only material needed. The device does not damage surroundings.

Repairs made with this device result in aligned, safe sidewalks, without makeshift or mismatched appearance caused by current repair methods.

DRAWING FIGURES

Figure 1:
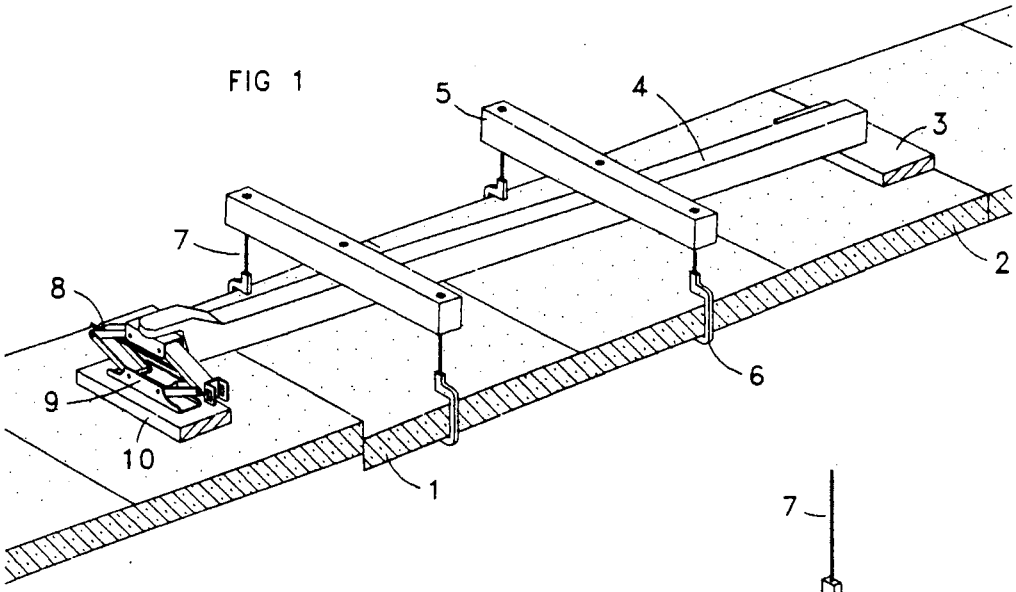
Figure 2:
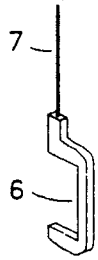
Figure 3:
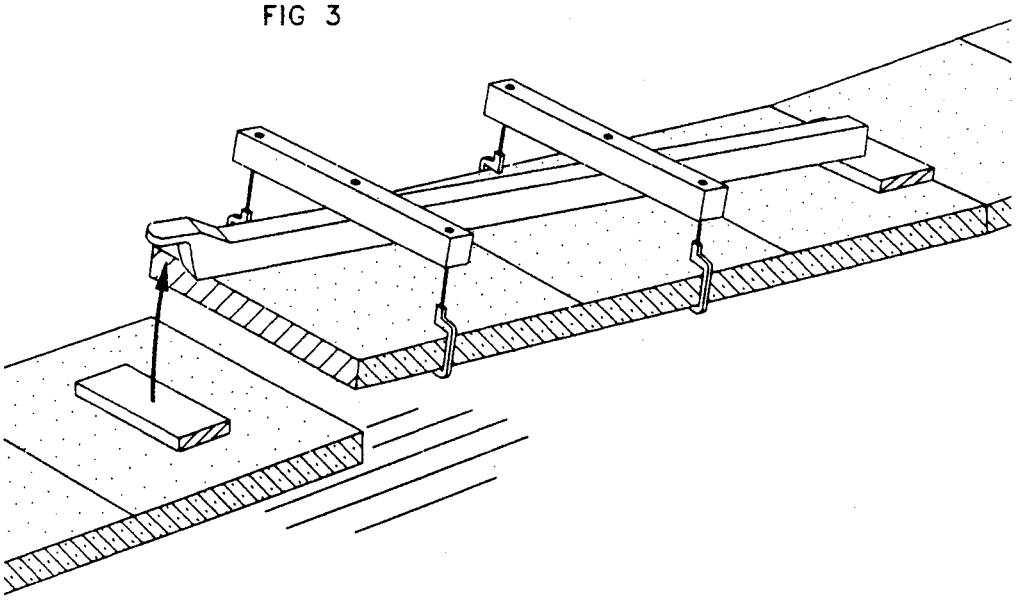
Figure 4:
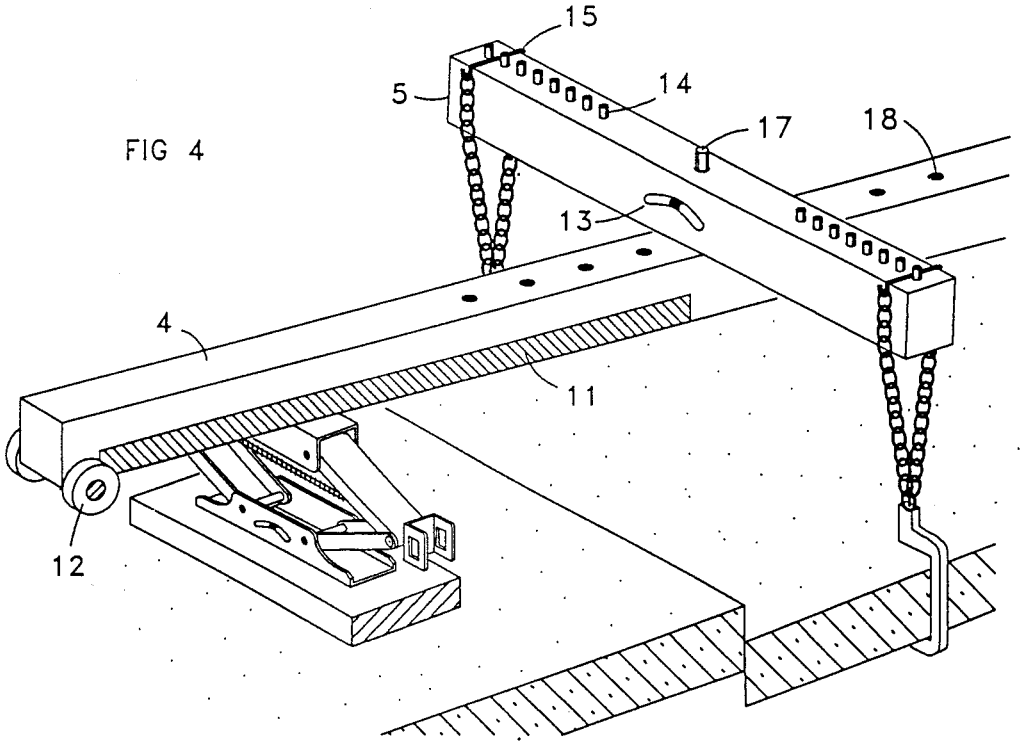
Figure 5:
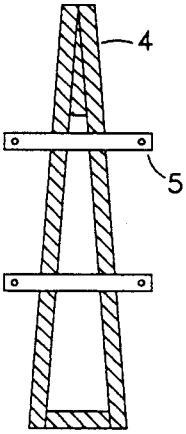
Figure 6:
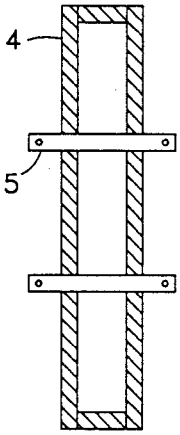
Figure 7:
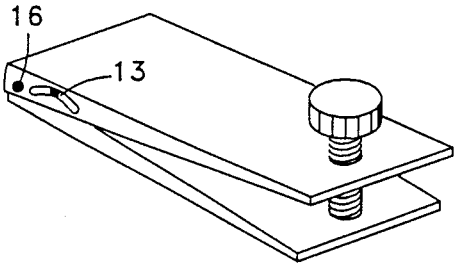

FIG. 1 - Installed sidewalk lifter
FIG. 2 - Hook detail
FIG. 3 - Sidewalk lifter, showing lift motion
FIG. 4 - Enhancements
FIG. 5 - Multiple main beams, top view
FIG. 6 - Another multiple main beam configuration, top view
FIG. 7 - Level adjustment pad

DRAWING REFERENCE NUMERALS

1 Lift end of concrete section
2 Pivot end of concrete section
3 Pivot pad
4 Main beam
5 Cross beam
6 Hook
7 Hook suspension
8 Jack
9 Jack base
10 Jack pad

11 Jack-placement area
12 Casters
13 Level gauge
14 Suspension-point projections
15 Chain coupler
16 Hinge
17 Pin
18 Pin holes

DESCRIPTION

FIG. 1 illustrates the lifting device, comprising a rigid main beam placed longitudinally upon the section to be lifted. The main beam acts as a lever, with its pivot end resting upon the pivot end of the concrete section, and its other end lifted by means of a jack. Cross beams extend laterally across the main beam, and hooks are suspended vertically from the cross beams to be hooked under the slab sides. One or more main beams, and one or more cross beams may be used.

The hooks are C-shaped, so that lifting force can be exerted on the underside of the sidewalk a short distance inward from its edge and directly below the hook-suspension point. This provides stable, non-slip lift points. Two hooks per cross beam provide symmetrical, distributed lifting force, which is stable, and avoids cracking the concrete.

The invention contacts the lifted slab on at least 3 points (two hooks and the pivot base), such that it moves in unison with the slab. The footing of this unified assembly comprises a point (the jack footing) and a line (the pivot edge of the slab). This geometry has the stablility of a tripod, with no tendency to tip or slide.

A prototype has been used with its cross beams set upon the main beam without fastening, and with suspension chains looped over the cross beams without fastening. The inherent stability of the device was demonstrated. The preferred embodiment includes fastenings for the cross beams and hold-points for the suspension means. This simplifies installation and provides additional safety.

A cross beam can be fastened to the main beam by passing a pin vertically through the center of the cross beam into one of a series of holes along the top of the main beam. This provides adjustment of cross beam placement for different section lengths, centers the cross beam laterally, and allows the cross beam to rotate against the main beam for compact handing and stowing.

Since sidewalks vary in width, the hook-suspension points on the cross beams should be laterally adjustable. Chain loops are suggested for suspending the hooks. A series of short projections along the top of the cross beams can guide and anchor the chain loops, as shown in FIG. 4.

Chain loops also make vertical adjustment convenient via coupling devices such as quick-connect links, snap hooks, or two-ended hooks as in FIG. 3 item 15. Vertical adjustment is needed to compensate for variations in section length, vertical displacement, and lateral tilt. If a section is tilted laterally, the suspension must be adjusted to different lengths on opposite ends of the cross beams to keep them level.

When loops are used for hook-suspension, slippage should be allowed at the hook or cross-beam connection, to equalize force on the two sides of the loop. An appropriate suspension-to-hook connection is a large smooth eye on the hook, through which the suspension material passes, allowing slippage like a pulley. A pulley can be used, but a large smooth eye is adequate and less expensive. Slippage insures that both sides of the loop are load-bearing, thus doubling the safe capacity of the suspension.

A useful enhancement is the inclusion of a level gauge in elements such as the cross beams, jack base or pad, and pivot pad. Level adjustment means should be provided in the jack pad or base, and in the pivot pad. Devices such as screw-adjustable feet or plates, shims, and the like can be used. An example of an adjustable pad for use as the jack pad and pivot pad is shown in FIG. 7. It has two plates, hinged together at one edge, with screw adjustable separation at the other end. A level gauge is installed in the upper plate. Cross beams are leveled by adjusting the length of the hook suspension on each side. A level gauge 13 is shown in FIG. 4 in the cross beam, and another in the jack base.

A jack may be provided with this invention, either attached or separate, or it may be user supplied. For the purpose of this application, the term, 'lift means', describes broadly any structure and/or mechanism which makes lifting of the device practical. This may be simply a surface appropriate for jack placement, and/or it may include a jack mechanism. The term, 'jack mechanism', means any mechanism providing a mechanical advantage for lifting objects.

Of the various types of automotive jacks, the scissor type, as in FIG. 1, are appropriate for this useage, since they have a good range of lift and use rotary drive. However, their mechanical advantage is at its minimum at the start, when it is needed most. Rotary drive is preferred for two reasons: its smooth motion avoids cracking the concrete; and it can be motor driven to save labor and time. Desirable jack features include smoothness of operation, a lifting range of at least 1 foot, and motor drive. A hardened area for jack placement should be provided on the underside of the main beam toward its lift end. This may include projections to stabilize jack contact, since many jacks have a depression in their lift contact surface. Projections may alternate with flat surface to provide two contact options.

A jack mechanism can be attached to the main beam. If so, it should have a mounting which allows adjustable positioning along the main beam. This allows selection of the best lift point for each section length. A 12-volt motor drive is a suggested option when frequent use is anticipated, such as by public works departments.

Assuming the maximum section of sidewalk to be lifted is about 12 feet in length, the jack mechanism should have a capacity of at least 2000 pounds. A concrete slab dimensioned 12 feet ×4 feet ×4 inches weighs about 1800 pounds. The jack only lifts half that weight, since the other half is supported by the ground at the pivot end. However, extra capacity is suggested to overcome binding, and as a safety margin. A 4000 pound jack capacity is about optimum for average-to-heavy sidewalk adjustments. A lesser jack could be used for light duty by a homeowner to adjust the front walk to the house.

The invention can be provided assembled, unassembled, or as a kit. An inexpensive kit can include instructions and some hardware, but may allow the user to buy materials separately for items such as beams and suspension means. This gives the user a wide choice of configurations from one standard kit.

FIGS. 5 and 6 illustrate two alternate configurations with multiple main beams (top view).

Preferred Embodiment

The preferred embodiment is similar to FIGS. 1 and 4, comprising:

(a) a single main beam, (b) two cross beams, (c) scissor jack with optional motor drive, (d) a hardened jack placement area on the underside of the main beam with projections to stabilize jack contact (e) built-in level gauges on the cross beams, as in FIG. 4

(f) fastening means for cross beams, comprising a removable pin inserted through a cross beam at its midpoint into one of a series of holes on the upper side of the main beam, (h) hooks suspended by adjustable chain loops, (i) a series of projections on top of cross beams, for lateral fixation of the chain loops, (j) casters on one end of main beam for handling ease, (k) Level-adjustment jack and pivot pads, as in FIG. 7.

Operation

The main beam is placed longitudinally on the center of the section, with its pivot end resting on a pad of material such as wood to distribute the weight on the pivot end of the section. A jack is placed on the section adjacent the lift end, about a foot away from the joint, and the main beam is set on the jack. Hooks are placed on opposite sides of the slab, and cross beams are placed upon the main beam positioned above each pair of hooks. Suspension means, such as chain, is passed from the hooks vertically to the cross beams, and adjusted to remove slack and to level the cross beams. The levelness of the cross beams and jack is checked, then the jack is operated to lift one end of the section. It should be lifted to provide at least 4 inches of clearance at the raised end, allowing dirt to be thrown under the section with a shovel, and spread with a long-handled spreader.

If the jack range of travel is insufficient, a stand is used to support the raised beam while the jack is reset on a taller base, such as a concrete block, for additional height.

This invention can find use in several types of realignment situations. In the case of a section lifted by roots, the adjacent section can be raised to match. The roots should also be cut, and a root barrier installed, to prevent further lifting. It is possible to lower a section by lifting it and removing dirt from beneath it. However, roots can make this more difficult than raising the adjacent section.

If a section is tilted laterally, it can be leveled by leveling the dirt underneath it. To guide this, a long-handled dirt-spreading tool with an inclinometer in its handle would be useful. Perfect leveling is not always desirable, since adjacent sections may not be level. Spreading dirt to match the slope of an adjacent section can be done by eye, although a spreader with an inclinometer would be helpful, since it can be used to measure the slope of the adjacent section, and then reproduce that slope.

Preparation for lifting of a section includes removal of potential binding points. A gap is required at either or both ends of the section. At its pivot end, the vertical surface of the lifted section will lean toward the adjacent section during the lift. If a gap is not available there, the lifted section will lean against the adjacent section and travel away from it. This is acceptable if the gap at the lift end is adequate. Otherwise, additional clearance should be made at one or both ends with a masonry saw. Most circular saws make a masonry cut at least 2 inches deep and 3/16 inch wide. Such a cut at each end of a section is adequate in most cases. If binding occurs when lifting starts, the gap at the lift end is not adequate. If binding occurs when lowering the slab, it should be pushed toward the pivot end while partially suspended at the binding point, so that it falls into place.

A simple formula for the total gap space required, is the lift distance divided by the section length multiplied by the section thickness (in like units). For example, with a 10-foot section, 4 inches thick, lifted 1 foot, the required gap space is 12/120*4=0.4 inches. This simple formula is suggested for practical estimation. It ignores factors which are relatively small and which tend to cancel others, such as the following:

(1) A section tends to travel horizontally toward its pivot end when lowered, due to the vector of lift toward that end. This is only a slight effect, but partially cancels travel of the section away from its pivot end when lifted, due to its leaning against the adjacent section.

(2) A section travels toward its pivot end when lowered if, due to a tight fit, it wedges against the adjacent section at its lift end, assuming it does not bind too severely to fall into place.

(3) The radius length from a section's pivot line to its lower edge at the lift end must be accomodated by the gap space. This radius length only exceeds the length of the section when the pivot line is above the lower edge of the section's pivot end. Even then, the excess length is normally less than the amount of lean calculated by the formula, so this factor is normally insignificant if the formula is used.

It is advisable to deeply edge any grass beside the section to be lifted. This avoids sod slipping under the section as it is lowered.

Claim terminology

"Lateral" means transverse to the main beam and generally horizontal.

"Lateral inclination" means the degree of variance from the horizontal, of the lateral dimension of elements and surfaces of the device.

I claim:

1. A device for lifting one end of a concrete slab, comprising:

a rigid main beam;

a rigid cross beam mounted on said main beam, said cross beam having a length approximately equal to the width of said slab and extending transversely to said main beam laterally on opposite sides thereof;

two hooks shaped to exert stable upward force on the underside of said slab, at positions inward of the edge of the slab, when said hooks are lifted;

flexible suspension means for connecting said hooks to said cross beam approximately above opposite edges of said slab; and jack means for lifting one end of said main beam.

2. The device of claim 1, further including means for fastening said cross beam to said main beam.

3. The device of claim 2 wherein said fastening means comprises a hole in the upper side of said main beam, a hole in said cross beam, and a pin for insertion through the cross beam into the main beam.

4. The device of claim 1, further including means for adjusting the spacing between said suspension means, such that said hooks can be suspended at a range of widths, or lateral distances, from said main beam.

5. The device of claim 1, further including means for vertically adjusting said suspension means, such that said hooks can be suspended at a range of heights below said cross beam.

6. The device of claim 1, wherein said hooks have a substantially C-shaped cross section, and have suspension attachment means near the end of one extremity of the 'C'.

7. The device of claim 1 wherein said lifting means comprises a lifting area on said main beam suitable for placement of jack.

8. The device of claim 1 wherein said jack means comprises a jack mechanism attached to said main beam, and a mounting which allows adjustable positioning of said jack mechanism along said main beam, whereby a desirable lift point can be selected.

9. The device of claim 1, further including means, attached to said device, for indicating the lateral inclination of said device.

10. The device of claim 1, further including means for adjusting the lateral inclination of said device.

11. The device of claim 10 wherein said lateral inclination adjusting means comprises two rigid plates hinged together, and means for adjusting the hinge angle between said plates.

12. The device of claim 11, further including a level gauge attached to one of said plates.

13. A kit comprising instructions and parts for building said device defined by any one of claims 1–12 of this application.

* * * * *